United States Patent [19]

Kaneko et al.

[11] 4,421,789

[45] Dec. 20, 1983

[54] PROCESS FOR TREATING THE SURFACES OF ALUMINUM HEAT EXCHANGERS

[75] Inventors: Hideaki Kaneko, Tokyo; Kazuhisa Naito, Chiba, both of Japan

[73] Assignee: Occidental Chemical Corporation, Warren, Mich.

[21] Appl. No.: 393,000

[22] Filed: Jun. 28, 1982

[30] Foreign Application Priority Data

Jun. 30, 1981 [JP] Japan ..... 56-101703

[51] Int. Cl.[3] ..... B05D 5/04

[52] U.S. Cl. ..... 427/204; 165/133; 428/325; 428/450; 427/397.7; 427/409

[58] Field of Search ..... 165/133; 428/325, 450; 427/204, 180, 397.7, 409

[56] References Cited

U.S. PATENT DOCUMENTS

| | | | |
|---|---|---|---|
| 2,298,079 | 10/1942 | Adams et al. | 427/204 |
| 3,181,461 | 5/1965 | Fromson | 430/274 X |
| 3,279,316 | 10/1966 | Penton et al. | 427/204 X |
| 3,973,510 | 8/1976 | McCulloch | 427/204 X |
| 4,054,467 | 10/1977 | Mikelsons | 427/204 |
| 4,074,010 | 2/1978 | Knight | 427/204 X |
| 4,211,276 | 7/1980 | Itoh et al. | 165/133 |

*Primary Examiner*—Shrive P. Beck

*Attorney, Agent, or Firm*—Richard P. Mueller

[57] ABSTRACT

A method for the treatment of aluminum surfaces to provide them with a corrosion resistant, hydrophilic coating. The aluminum surfaces are first provided with a corrosion-resistant film and, thereafter, a coating of fine silica particles is applied to the corrosion resistant film. Suitable corrosion resistant films which may be used are anodized films, boehmite films, chromated films and organic resin films. The coated aluminum surfaces produced by this method are found to have particular application for aluminum heat exchangers.

8 Claims, No Drawings

PROCESS FOR TREATING THE SURFACES OF ALUMINUM HEAT EXCHANGERS

This invention relates to a process for the treatment of the surfaces of aluminum heat exchangers and, more particularly, relates to the formation of a coating on the surfaces of aluminum heat exchangers which is hydrophilic as well as providing corrosion-resistance.

BACKGROUND OF THE INVENTION

In the past, various surface treatments have been carried out on aluminum heat exchangers and their fins, to provide a coating which would prevent the formation of "white rust", i.e., white corrosion deposits. These processes have included anodizing, hot water or steam treatment to form boehmite films, resin film treatments and the like. While the protective coatings produced by these processes have been effective in preventing or at least minimizing the formation of "white rust", the surfaces of these coatings have been substantially unwettable and, in many instances, have been water-repellent. Chromate films have also been used to provide corrosion protection. Although these films, initially, are, at least to some extent, water wettable, in the course of time, particularly under hot, dry conditions, the surface of these films change rom hhydrophilic to hydrophobic.

As is well known, although heat exchangers are designed to have the surface areas of the heating and cooling parts as large as possible in order to increase the heat radiation or cooling effect, they typically have very small or narrow spacings between the fins. As a result, particularly in the case of cooling, atmospheric moisture collects on the heat exchange surfaces, and particularly in the fin spacings. To the extent that the fin surface is hydrophobic, the collected water forms in drops, thus blocking the fin spacings and, thereby, increasing the air flow resistance and reducing the heat exchange efficiency. Additionally, the water drops accumulated in the fins spacings may be easily scattered by the blower of the heat exchanger and are, thus, apt to overflow from the water drip trays set up in the lower part of the heat exchangers and contaminate the area of the heat exchanger with water.

In order to prevent the blockage of the spacings between the fins by the residual water drops, the aluminum surfaces have heretofore been treated to make them hydrophilic and to increase their wettability. Generally, however, the treatments to increase wettability have not imparted corrosion resistance to the surfaces as well. Although the water would generally flow away from a surface which has been made hydrophilic without causing appreciable corrosion, the hydrophilic nature of the surfaces treated in accordance with the prior art have become easily impaired during the use of the heat exchanger. When this occurs, significant corrosion of the heat exchange surfaces results.

It is, therefore, an object of the present invention to provide a process for the treatment of aluminum heat exchanger surfaces which eliminates the problems which have heretofore been encountered in the art.

A further object of the present invention is to provide a surface treatment for aluminum heat exchangers which increases the wettability of the surfaces, while providing corrosion resistance and preventing the formation of "white rust".

These and other objects will become apparent to those skilled in the art from the description of the invention which follows.

SUMMARY OF THE INVENTION

In accordance with the method of the present invention, aluminum heat exchanger surfaces are treated to provide a corrosion resistant coating on the surface. Thereafter, a coating of fine silica particles is applied to the corrosion resistant coating. Typical of the corrosion resistant coatings which may be utilized are anodized coatings, boehmite coatings, resin coatings and chromate coatings. The resulting composite coating is found to provide a wettable film on the aluminum heat exchanger surfaces, which film has corrosion resistance and prevents or minimizes the formation of "white rust" on the surface.

DETAILED DESCRIPTION OF THE INVENTION

More particularly, in the practice of the method of the present invention, aluminum heat exchanger surfaces are first treated to provide a corrosion resistance coating or film on the surface. This corrosion resistant film may be formed by means of conventional anodizing processess, as are well known in the art, or by treatment of the aluminum surface with hot (boiling) water or steam to form a boehmite film, as is also well known in the art. Particularly preferred treatments for forming corrosion resistant coating on the aluminum heat exchanger surfaces are those which provide chromated films or resin films.

In the case of the processes for providing chromated films, these are generally of the chromic acid-chromate or phosphoric acid-chromate type, both of which are well known in the art. In general, chromic acid-chromate coatings are formed by treating the aluminum surface with an aqueous solution containing chromic acid, an alkali metal dichromate and an alkali metal fluoride, bifluoride or complex fluoride. Similarly, the phosphoric acid-chromate type coatings are formed by treating the aluminum surface with an aqueous solution containing phosphoric acid and/or alkaline metal phosphates, chromic acid and/or alkaline metal chromates or dichromates, and alkaline metal fluorides or bifluroides. Although either the chromic acid-chromate or phosphoric acid-chromate type coatings may be utilized in the present invention, somewhat greater corrosion resistance is often obtained with the chromic acid-chromate type, which type is, thus, particularly preferred.

In the case of corrosion resistance resin films, substantially any industrially used organic high molecular weight resin may be used. Such resins include vinyl acetate, vinyl chloride, vinylidine chloride and similar vinyl type resins and their copolymers; methacrylic acid, acrylic ester, methacrylic ester, hydroxyacrylic acid, hydroxymethacrylic acid and the like acrylic type resins and their copolymers; alkyd type resins; epoxy resins; fluorine type resins; urethane resins; polyester resins; styrene resins; olefin type resins; and their copolymers; butadiene and the like synthetic rubber type resins, as well as natural rubber type resins.

Generally, it is preferred that the organic high molecular resins are those which have a molecular weight of at least 1,000. While those having molecular weights below 1,000 can be used, in this instance, it is necessary to select those which, by means of oxidated polymerization reactions or cross linking polymerization reactions at the time of the film formation are insoluble in water.

The resin film treatment utilized will be one which will provide a thin resin film having good corrosion resistance on the aluminum heat exchanger surfaces. Desirably, the film thickness will be as thin as possible, typically 10 microns or less, with film thicknesses of 2 microns or less being particularly preferred. A particularly suitable resin film is one having a film thickness of from about 0.2 to 2 microns which is formed from a solution of a water-soluble thermoplastic high molecular weight resin consisting of the copolymer of an alpha-olefin and an alpha, beta unsaturated carboxylic acid.

After the application of the corrosion resistant film to the aluminum heat exchanger surface, a coating of fine silica particles is applied to the thus-treated surface. The coating of fine silica particles may be applied in any convenient manner, including the application from the powder state. Generally, however, from the standpoint of surface adhesiveness and durability, the preferred method of application is from an aqueous solution in which the fine silica particles are suspended in water.

The fine silica particles possess surface silanol (—SiOH) groups which are dissociated in water and then have a negative charge. The water dispersion of these particles has been found to be stable. Upon drying of this aqueous suspension which has been applied to the corrosion resistant film, the silica particles, adhering to the film surface, aggregate in mutual association. Once they are adhered or aggregated, the silica particles become difficult to redisperse and very difficult to remove from the film surface. The durability of this coating is very high with substantially no change over extended periods of time. The silanol groups on these particles which do not participate in the particle adhesions to the corrosion resistant film absorb water molecules, thus providing a hydrophilic surface.

Any suitable source of the silica particles may be utilized, including silica sols and high molecular weight anhydrous silicic acid particles, the latter being particularly preferred. The silica particles utilized should not dissolve in water and, preferably, contain substantially no sodium oxide. Typically, the fine silica particles will have a particle size from about 1 to about 100 millimicrons.

The amount of the silica particles applied to the surface of the corrosion-resistant film on the aluminum heat exchanger surface will vary with the wettability of the corrosion-resistant film itself, as well as with the degree of wettability of the surface which is desired. Thus, the silica particles will be applied in an amount which is at least sufficient to provide the desired wettability of the corrosion-resistant film. Typically, the coating weight of the adhered silica particles will be at least about 0.01 g/m$^2$, with coating weights within the range of about 0.01 to about 5 g/m$^2$ being preferred. Where the coating weight is less than about 0.01 g/m$^2$, it may be difficult to obtain a sufficiently hydrophilic surface. The use of coating weights in excess of about 5 g/m$^2$ have, generally, not been found to provide significant additional increases in the hydrophilic characteristic of the surface. Surface higher coating weights do not adversely effect the hydrophilic nature of the surface and are only disadvantageous from an economic standpoint. Typically, the application of from about 0.1 to about 0.5 g/m$^2$ of the adhered silica particles on a chromated film will result in a water contact angle of less than about 30°, which will provide a hydrophilic surface of practical utility. Such a system is, thus, particularly preferred.

The aqueous dispersion of the fine silica particles may be formed in a wide range of concentrations, depending upon the coating weight of adhered particles which is desired. Typically, aqueous dispersions containing from about 1 to about 10 percent of the silica particles may be used. If desired, these solutions may be made slightly alkaline, a pH of from about 9 to 10 being typical, by the addition of aqueous ammonia. Additionally, one or more wetting agents may also be included in this solution. The solutions may be applied to the corrosion resistant coated aluminum surface in any convenient manner, typically by immersion, for a period sufficient to form the desired coating weight of particles on the surface. Thereafter, the residual moisture is removed from the adherent particle film.

SPECIFIC EXAMPLES

In order that those skilled in the art may better understand the present invention and the manner in which it may be practiced, the following specific examples are given.

EXAMPLES 1-3

Aluminum test panels were degreased, washed and immersed in a commercial chomic acid-chromate conversion coating solution, sold under the registered trademark BONDERITE® 713 by Nippon Parkerizing, for about one minute at 50° C. to form a chromated corrosion resistant film having a coating weight of 80 mg/m$^2$, as chromium. The thus-treated test panels were then washed and dried and were then immersed in slightly ammoniacal alkaline aqueous solution (pH 9 to 10) containing, respectively, 1, 3 and 5 percent by weight of dispersed, fine silicic acid particles, sold under the registered trademark AEROSIL® 200 by Nippon Aerosil. After removing the panels from the silicic acid particles dispersion, they were dried for three minutes in a hot air circulation type drying oven at 130° C.

EXAMPLE 4

The procedure of Example 1 was repeated with the exception that the panels on which the chromated corrosion resistant film had been formed were not immersed in the dispersion of silicic acid particles and, thus, had only the chromated corrosion resistant film.

EXAMPLE 5

Aluminum test panels which had been degreased and washed were immersed in a commercial phosphoric acid-chromate corrosion coating solution, sold under the registered trademark BONDERITE® 701 by Nippon Parkerizing, for 90 seconds at 50° C. to form a phosphoric acid chromated film having a coating weight of 100 mg/m$^2$, as chromium. The thus-treated panels were water washed and dried and were then immersed in a 5% by weight aqueous silica sol solution, sold under the registered trademark SNOTEX® C by Nissan Chemical. After removal from the aqueous silica sol solution, the residual moisture in the coating was removed by drying the panels in hot air.

EXAMPLE 6

The procedure of Example 5 was repeated with the exception that after the application of the phosphoric acid-chromate corrosion resistant film, the panels were not immersed in the aqueous silica sol solution so that the resulting panels contained only the phosphoric acid-chromate conversion coating.

EXAMPLE 7

Aluminum test panels were treated with the phosphoric acid-chromate conversion coating solution as in Example 5. Thereafter, the panels were immersed in a 5% by weight aqueous solution of sodium silicate, sold under the designation #1 SODIUM SILICATE® by Nippon Chemical Industries. After removal from the sodium silicate solution, residual moisture was removed from the silicate coating by drying the panels in hot air.

EXAMPLE 8

A reaction mixture was prepared containing 22 grams of an ethylene-acrylic acid copolymer, 43 grams of 28% aqueous ammonia and 73.7 grams deionized water. This mixture was heated for one hour at 130° C., with stirring. The mixture was then cooled and adjusted to a pH of 9.5±0.5 with 28% aqueous ammonia to give a resin solution having a resin solid content of about 22%. This resin solution was then diluted to a 10% concentration and degreased, water-washed aluminum test panels were immersed in the solution for 10 seconds at 20° C. The panels were removed from the resin solution and moisture was removed by squeezing with rubber rolls and then drying for 30 seconds in hot air at 130° C. to provide a dried, corrosion-resistant film on the panels having a coating weight of about 1.5 g/m$^2$. The thus-treated panels were then immersed in a 5% by weight aqueous silica sol solution, sold under the registered trademark SNOTEX® C by Nissan Chemical, which also contained 0.5% by weight of a nonylphenol surfactant. After removal from the silica sol solution, residual moisture in the film was removed by rubber roller squeezing and drying for one hour in hot air at 130° C.

EXAMPLE 9

The procedure of Example 8 was repeated with the exception that after formation of the corrosion resistant resin film on the panels, the panels were not immersed in the silica sol solution so that the resulting panels contained only the corrosion resistant resin film.

The panels produced in accordance with the preceeding Examples 1 through 9 were then tested to determine the water contact angle and also the corrosion resistance of the panels. The contact angle of water droplets, 1–2 mm in diameter, was measured using a goniometer-type contact angle measuring apparatus, G-1, manufactured by Elmer Optical Company Ltd., which was used at normal temperatures. Measurements were made on panels initially after processing, after one week of immersion in running water, and after being maintained for one week in a 40° C. constant temperature chamber. The corrosion resistance of all of the test panels was determined based on the salt water spray method, JIS Z-2371. Using these procedures, test results as shown in the following table were obtained:

TABLE

| Example No. | Amount of adherent silicic acid (g/m$^2$) | Water contact angle (°) Initial | After running water immersion | After 40° C. heating | Corrosion resistance SST |
|---|---|---|---|---|---|
| 1 | 0.15 | 0 | 7° | 24° | 240 hr |
| 2 | 0.45 | 0 | 6° | 14° | 240 hr |
| 3 | 0.75 | 0 | 7° | 15° | 240 hr |
| 4 | 0 | 56° | 59° | 84° | 240 hr |
| 5 | 0.75 | 6° | 8° | 11° | 240 hr |
| 6 | 0 | 59° | 45° | 68° | 96 hr |
| 7 | 0.75 | 0 | 36° | 12° | 72 hr |
| 8 | 0.45 | 0 | 11° | 28° | 240 hr |
| 9 | 0 | 97° | 95° | 101° | 240 hr |

EXAMPLE 10

The procedures of the preceeding Examples 1 through 9 is repeated with the exception that the corrosion resistant films formed on the test panels are anodized films and boehmite films. The resulting test panels are subjected to the same water contact angle and corrosion resistant test and, in each instance, comparable results to those set forth in the above table are obtained.

From the foregoing, it is apparent that by the method of the present invention, coatings are formed on aluminum surfaces which are not only hydrophilic but which also provide significant corrosion protection to the surface. Comparable results were not obtained when the corrosion resistant film was utilized without the application of the fine silica particle film or when the corrosion resistant film was used in combination with a silicate film. The aluminum surfaces treated in accordance with the present invention have been found to have particular application for use as aluminum heat exchanger surfaces.

What is claimed is:

1. A method for the treatment of aluminum surfaces to provide thereon a corrosion resistant, hydrophilic coating which comprises forming on said aluminum surface a corrosion-resistant film having a thickness which is not in excess of about 10 microns and, thereafter, applying to said corrosion resistant film a top coating of fine silica particles, having a size within the range of about 1–100 millimicrons, the amount of said silica particles applied being at least sufficient to impart the desired degree of water wetability to the surface.

2. A method for the treatment of aluminum surfaces to provide thereon a corrosion-resistant, hydrophilic coating which comprises forming on said aluminum surface a corrosion-resistant film and, thereafter, applying to said corrosion-resistant film a coating of fine anhydrous silicic acid particles in an amount at least sufficient to impart the desired degree of water wetability to the surface, said anhydrous silicic acid particles being applied as an aqueous dispersion.

3. The process as claimed in claim 1 in which the silica particles are applied as an aqueous dispersion.

4. The process as claimed in claim 3 in which the silica particles are anhydrous silicic acid particles.

5. The process as claimed in claim 3 in which the silica particles are a silica sol.

6. The process as claimed in claim 1 in which the coating weight of the applied silica particles is at least 0.01 gm/m$^2$.

7. The process as claimed in claim 6 in which the coating weight of the applied silica particles is from about 0.01 to about 5.0 gm/m$^2$.

8. The process as claimed in claims 3, 4, 5, 6, 7, 1, or 2 in which the corrosion resistant film is selected from an anodized film, a boehmite film, a chromated film and an organic resin film.

* * * * *